US005399092A

United States Patent [19]

Olsen

[11] Patent Number: 5,399,092

[45] Date of Patent: Mar. 21, 1995

[54] PSYCHOLOGICAL ANALYSIS, COMMUNICATION, AND EDUCATIONAL APPARATUS

[76] Inventor: Rosalyn N. Olsen, 922 Chestwood Ave., Tallahassee, Fla. 32303

[21] Appl. No.: 172,531

[22] Filed: Dec. 23, 1993

[51] Int. Cl.[6] ..... G09F 9/00

[52] U.S. Cl. ..... 434/238; 434/236

[58] Field of Search ..... 434/430, 236, 238

[56] References Cited

U.S. PATENT DOCUMENTS

| | | | |
|---|---|---|---|
| 2,918,730 | 12/1959 | Schraas | 434/238 |
| 3,691,652 | 9/1972 | Clynes | 434/236 |
| 3,782,009 | 1/1974 | Parnell | 434/238 |
| 4,344,759 | 9/1982 | Albert | 434/430 |
| 4,741,701 | 5/1988 | Kossor | 434/238 |
| 4,795,348 | 1/1989 | Garthwaite | 434/430 |
| 5,040,988 | 8/1991 | Brown | 434/238 |
| 5,131,899 | 7/1992 | Perrero | 434/430 |

*Primary Examiner*—Paul J. Hirsh

*Attorney, Agent, or Firm*—Carnes, Cona, Dixon

[57] ABSTRACT

An apparatus that aids in the diagnosis and analysis of an individual suffering from a psychological ailment. The apparatus contains a top end and a bottom end wherein the top end represents a manic region and the bottom end represents a depression region. Between these two regions are the mild depression region, the normal region, and the hypomania region proceeding in order from bottom to top. Various elements that represent psychological states are provided so that the user can place the elements that represent that person's current state onto the appropriate region.

5 Claims, 2 Drawing Sheets

PSYCHOLOGICAL ANALYSIS, COMMUNICATION, AND EDUCATIONAL APPARATUS

BACKGROUND OF THE INVENTION

Many individuals suffer from some form of psychological problem. Few of these individuals will seek professional help, and those that do, face many obstacles. One such obstacle is communication between the individual sufferer and the mental health professional.

Typically, the individual seeking help will be asked a series of questions about the person's thoughts and feelings. These questions will be presented either on a paper questionnaire or will be asked by a staff member who will record the responses offered. The mental health provider will then process the answers received, in order to paint a picture of the individual's mental health state. From this picture, the provider will make a diagnosis and thereafter will prescribe a course of treatment. This method of provider-consumer communication suffers twin short-comings.

An individual suffering from a mental health affliction may not be able to express thoughts and feelings through questions and answers. The individual may know what he or she is thinking or feeling but may not be able to express this verbally. Or the person may find such questions cold and intrusive and may not wish to answer them, and may offer any answer just to be left alone.

The result is a communication breakdown with the message sent from consumer to provider being blocked or distorted. A course of treatment will be difficult to embark upon and if it is embarked upon, it will be distorted.

A second problem results in interpretation of the resulting answers by the provider. Even if the individual clearly answered all questions, the provider will require some time in order to assemble a mental health picture of the individual. Any picture so assembled will not necessarily be complete. Holes in the picture will be filled in during the course of treatment resulting in a refinement of the treatment as more of the picture comes into view. Such a course will not be an efficient use of resources and can even be counter-productive.

What is needed is an apparatus that will permit an individual to express his or her thoughts and feelings without the necessity of resorting to verbal semantics. Such an apparatus must permit effective communication and must be relatively simple to use. Furthermore, such an apparatus must permit the mental health provider to make a comprehensive diagnosis and analysis of a person's mental health state quickly so that an appropriate course of treatment may be commenced.

SUMMARY OF THE INVENTION

The present invention provides for an apparatus that will help in the diagnosis and analysis of an individual suffering from any psychological problem, such as depression or a mood disorder. This is accomplished by providing a device wherein the individual suffering from the psychological problem expresses his or her feelings in a visual manner. Once these feelings are visually displayed, the mental health provider will be able to make a rapid and accurate analysis of the individual's psychological state. The use of visual devices promotes and assists effective communication among the various individuals involved in the diagnostic and treatment processes associated with mental health treatment. These individuals include the person seeking treatment, the person's family, doctors, social workers, counselors, psychologists, etc.

The apparatus of the present invention consists of a structure, having a distinct base and a distinct top end. The overall structure is divided into several regions or areas. The top area of the structure is the mania region, the middle area is the "okay" region, and the bottom area is the depression region. Within the okay region just below the mania region is a hypomania area. Also within the okay region and just above the depression area is the mild depression area. Between the hypomania area and the mild depression area is the normal area.

The various elements include indicators, banners and a mixed state. The indicators are various symptoms and feelings that the individual is experiencing. These indicators are attachable to and removable from the main structure. The banners are diagnoses which may be rooted in a mood disorder. The banners, like the indicators, are attachable to and removable from the structure. The mixed state occurs when symptoms and/or feelings are experienced continuously or are rapidly alternating. The element used to represent the mixed state is permanently attached to the structure.

In order to utilize the apparatus, an individual would place the indicators and/or the banner(s) on the appropriate regions or areas on the structure (i.e. mania, mixed state, depression, hypomania, mild depression) to correlate with the individual's feelings. Due to the unique interaction between the apparatus of the present invention and the client, the individual will be able to express, clarify, and acknowledge his or her condition.

Once the indicators and/or banner(s) are properly placed on the structure, the mental health provider will have a comprehensive visual picture of the individual's mental health state. From this picture, an appropriate treatment plan can be devised and embarked upon.

Therefore, it is the object of the present invention to provide for a psychological analysis and communication apparatus that is completely individualized.

It is another object of the present invention to provide for a psychological analysis and communication apparatus that is easy to use and operate.

It is another object of the present invention to provide for a psychological analysis and communication apparatus that is a visual aid and can promote communication and discussion between the various individuals involved with mental health treatment including the client, doctor, social worker, counselor, psychiatrist, family members, teachers, etc.

It is another object of the present invention to provide for a psychological analysis and communication apparatus that will provide for the individual suffering from a psychological problem to be able to identify and express his or her feelings.

It is another object of the present invention to provide for a psychological analysis and communication apparatus that will monitor the progress of an individual who is in treatment for a psychological problem.

It is another object of the present invention to provide for a psychological analysis and communication apparatus that will be utilized as an education tool.

It is another object of the present invention to provide for a psychological analysis and communication apparatus that is inexpensive to fabricate and durable in operation.

DESCRIPTION OF THE PREFERRED EMBODIMENTS

Figure 1:
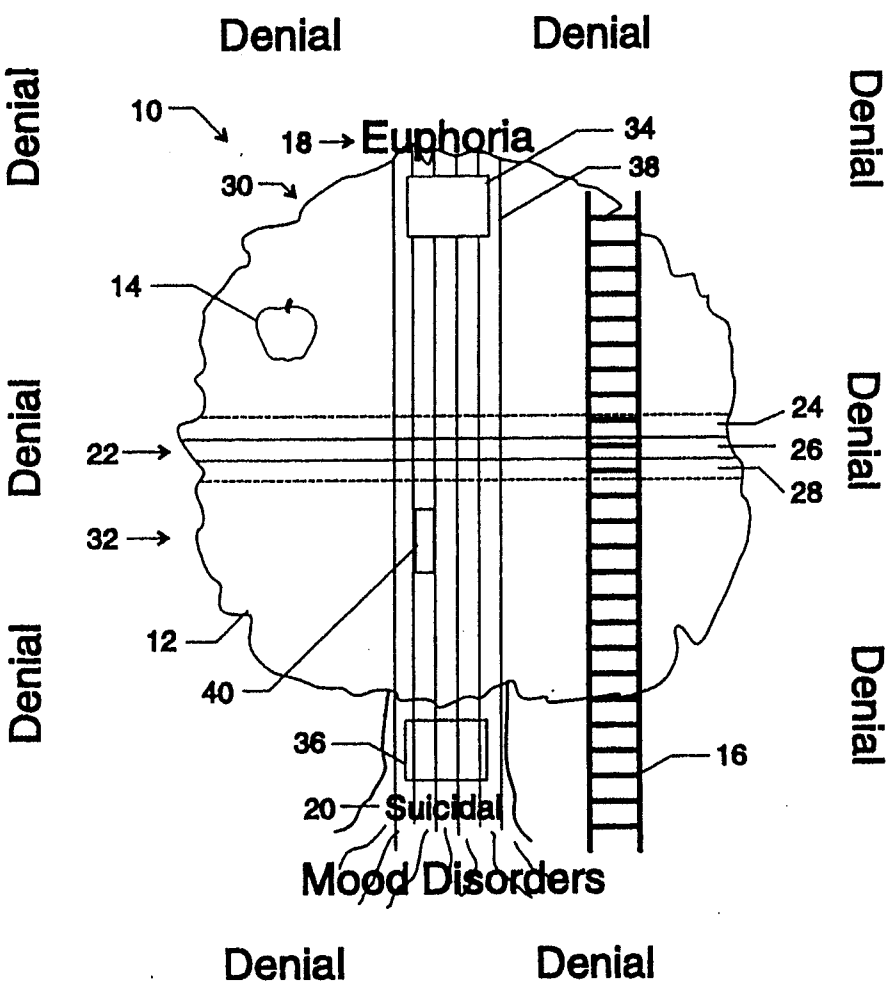
FIG. 1 is a front elevational view of one type of the psychological analysis and communication apparatus of the present invention.

Referring now in detail to the drawings, FIG. 1 shows a front view of the psychological analysis and communication apparatus 10 of the present invention. The main structure 12, illustrated as an apple tree, contains a variety of elements. Indicators 14 are the first set of elements and are represented as apples. The second element is the mixed state 16, which is represented as a ladder.

As FIG. 1 illustrates, the main structure 12 is divided into several sections. The top, or uppermost section 18 of the main structure is considered euphoria. While at the bottom, or lowermost area 20 of the main structure 12 is considered suicidal.

The middle area 22, is divided into three regions. The first region 24 is hypomania. Hypomania is a mood disturbance which is not severe and does not cause the individual marked impairment in social or occupational functioning and does not require hospitalization.

Located directly below hypomania is the "Okay" or normal state 26, wherein the individual experiences normal mood swings which are manageable. It is at this state where the majority of today's population exist.

The final or third region 28 of the middle area 22 is mild depression. Mild depression is a mood disturbance which is not severe and does not cause the individual marked impairment in social or occupational functioning and does not require hospitalization.

The section directly above the first region 24 of the middle area 22 is the mania area 30, while the section directly below the third region 28 of the middle area 22 is the depression area 32.

At the top portion of the main structure 2 of the psychological analysis apparatus 10 is another element of the shape of a block 34 that is labeled "self importance" or "omnipotence". This block signifies the typical feelings of an individual suffering from mania. Characteristically one experiences an inflated self-esteem, ranging from uncritical self-confidence to marked grandiosity, which may be delusional. This block 34 is permanently attached to the main structure. This block 34 represents "self importance" or "omnipotence" is not limited to this shape or any particular size and can include any design.

Located at the bottom portion of the main structure 12 of the psychological analysis apparatus 10 is another element in a shape of a second block 36 which is labeled "no self" or "total worthlessness". This second block 36 signifies the typical feelings of an individual suffering from depression. Characteristically, one experiences a sense of incompetence which varies from feelings of inadequacy to completely unrealistic negative evaluations of one's worth. This block 36 represents "no self" or "total worthlessness" and is not limited to this shape or any particular size and can include any design.

When an individual is suffering from mania, he or she will usually experience a predominant mood which is either elevated, expansive, or irritable. Additionally, typical symptoms are present when one is manic. These symptoms can include, but not be limited to, inflated self-esteem or grandiosity (which may be delusional), decreased need for sleep, pressure of speech, flight of ideas, distractibility, increased involvement in goal-directed activity, psychomotor agitation, and excessive involvement in pleasurable activities which have a high potential for painful consequences that the person often does not recognize. Further a person who is manic often does not recognized that he or she is ill and avoids and resist all efforts of treatment.

When an individual is suffering from depression, he or she will usually be either in a depressed mood or experience loss of interest or pleasure in all, or almost all, activities and associated symptoms for a period of at least two weeks. The associated symptoms may include, but not be limited to, appetite disturbance, change in weight, sleep disturbance, psychomotor agitation or retardation, decreased energy, feelings of worthlessness or excessive or inappropriate guilt, difficulty thinking or concentrating, and recurrent thoughts of death or suicidal ideation or attempts. Further, a person suffering from depression can also experience tearfulness, anxiety, irritability, brooding or obsessive rumination, excessive concern with physical health, panic attacks, and phobias.

The indicators 14 represent the various symptoms and features that can lead to a sense of what the person is experiencing or feeling. The indicators are illustrated as apples in this figure. The various indicators can include, but not be limited to the following: low self-esteem, can't stand pressures, money issues, poor judgment, migraine headaches, alcohol or drug use, bad temper, gastric problems, sleep disturbance, low energy, hopeless, crying, helplessness, suicidal thoughts, poor memory, can't make decisions, indifference, blackouts, poor hygiene, overeating, aches and pains, phobias, poor concentration, high energy, power issues, shopping sprees, lots of laughing, feeling smart, no meds (medication) for me, grandiosity, fast talking, fast thoughts, high sex, no appetite, and homicidal feeling. Additionally, several elements representing the indicators can be left blank in order to provide for the individual to write in his or her own personal feelings or symptoms that were not indicated above.

Also illustrated on the main structure are a plurality vertically aligned tracks 38. These tracks 38 are centrally located on the main structure 12 of the psychological analysis and communication apparatus XO. Banners 40, another element, can be provided on the tracks 38. The banners 40 are diagnoses which may be rooted in a mood disorder and may appear on either the first or second region, in combination of the first and second region, or not at all. Additionally, these symptoms indicated on the banners might improve or disappear if an individual is treated properly. These banners can include the following diagnoses, but not be limited to, agitation, paranoia, psychosis, confusion and anxiety.

These banners 40 can be placed anywhere along the tracks on the main structure.

Denial is a classic characteristic of an individual suffering from a psychological problem or mood disorder. In order to represent the classic and common characteristic, the word "DENIAL" surrounds the structure.

Figure 2:
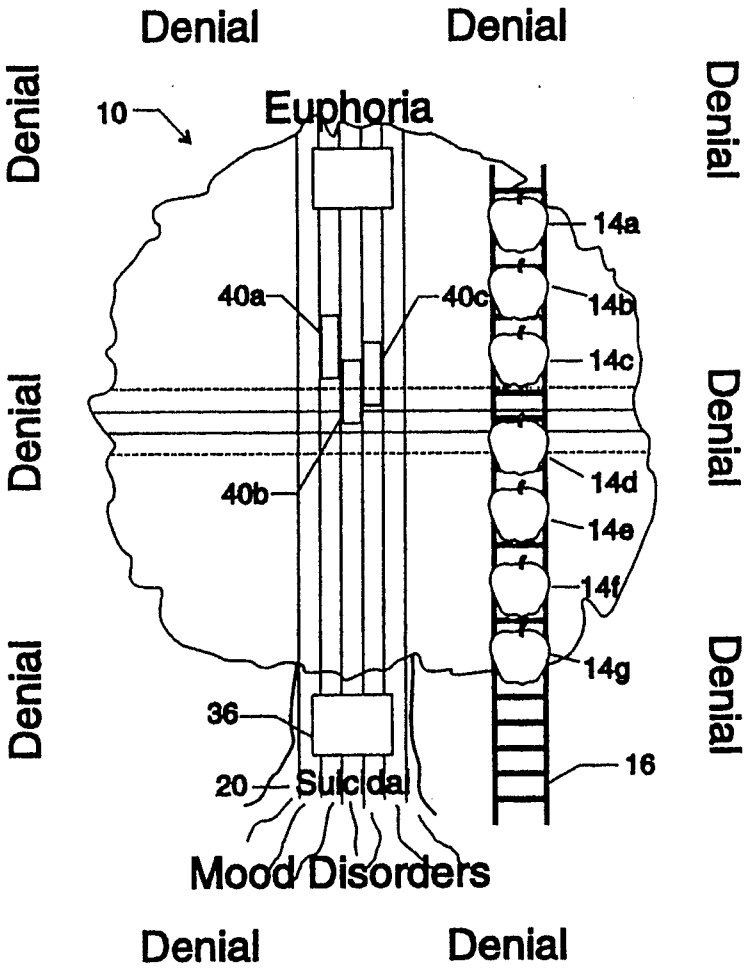
FIG. 2 is an example of a mixed state disorder analysis provided by the use of the psychological analysis and communication apparatus of the present invention.

In order to do a psychological analysis on the psychological analysis and communication apparatus 10, one would merely place the appropriate elements (indicators and/or banners) on the main structure 12. An example of a clinically typical mixed state is illustrated in FIG. 2, wherein an apple tree is utilized as the main structure and apples represent the various indicators. As seen in this figure, the subject placed the following indicators: fast thoughts 14*a*, power issues 14*b*, sleep disturbance 14*c*, hopelessness 14*d*, crying 14*e*, low energy 14*f*, and helplessness 14*g* all on the mixed state 16 (which is illustrated as a ladder in this example) in order to identify and express the symptoms and/or feelings he or she was experiencing. The reason why the subject placed his or her indicators on the mixed state is because he or she would experience these symptoms or feelings listed on the indicators at all times or they would occur rapidly cycling up and down. As also illustrated in this example, the subject placed the following banners on the tracks 38: agitation 40*a*, psychosis 4O*b*, and confusion 40*c* in order to identify the conditions he or she was experiencing. The doctor, counselor, social worker, etc., could clearly analyze the subject and treat him or her with the appropriate care. Additionally, the subject is also able to clearly see and analyze his or her own condition.

Any structure having various heights and elevations can be substituted for the main structure of the psychological analysis and communication apparatus, Examples of such structures are a building, pine tree, any fruit or nut bearing tree, etc. The main features that the structure must possess are a distinct base and a distinct top end, and markings delineating levels.

Color can also be utilized to give a more effective appearance, as well as to aid in delineation of the various areas and regions. For example, the top end can be of a yellow tone and gradually change to a blue tone, down toward the base.

Any fruit or nut (i.e. oranges, lemons, walnuts, etc.) can be used to portray the various mood disorders when a fruit or nut bearing tree is the main structure. Additional types of elements can be used for the portrayal of the indicators in order to correspond with the main structure. For example, if a building is the main structure, windows can be used for the representation of the indicators. If a pine tree is the main structure, then pine cones can be utilized for the various indicators.

The mixed state 16 is not limited to a ladder. Additional types of elements can be used for the depiction of this state in order to correspond to the main structure. For example, if a building is the main structure, then an elevator system can be used as the mixed state. The element representing the mixed state is permanently attached to the main structure. The structure can also be three-dimensional such as a globe.

Figure 3:
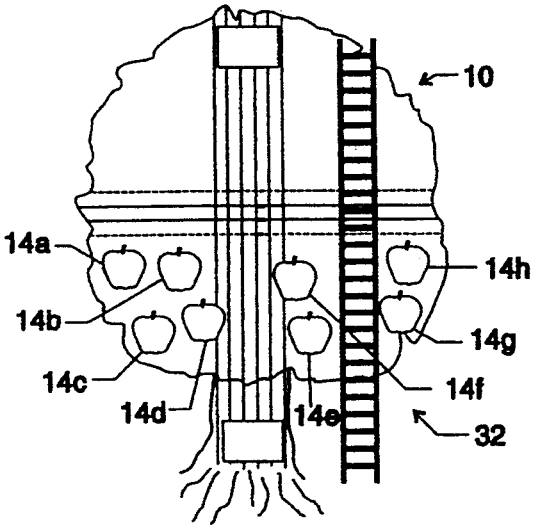
FIG. 3 is an example of a depression disorder analysis provided by the use of the psychological analysis and communication apparatus of the present invention.

An example of a clinically typical subject suffering from depression is illustrated in FIG. 3, wherein an apple tree is utilized as the main structure and apples represent the various indicators. As shown in this figure, the subject placed the following indicators: helpless 14*a*, sleep disturbance 14*b*, crying 14*c*, low energy 14*d*, poor judgment 14*e*, poor memory 14*f*, can't stand pressure 14*g*, and suicidal thoughts 14*h* all below the middle region in the depression area 32. These indicators 14*a*–14*h* were placed in the depression area by the individual in order to identify the symptoms and feelings that person was experiencing. The mental health professional could clearly analyze the individual and treat him or her with the appropriate care. The subject is also able to clearly see and analyze his or her own condition.

Figure 4:
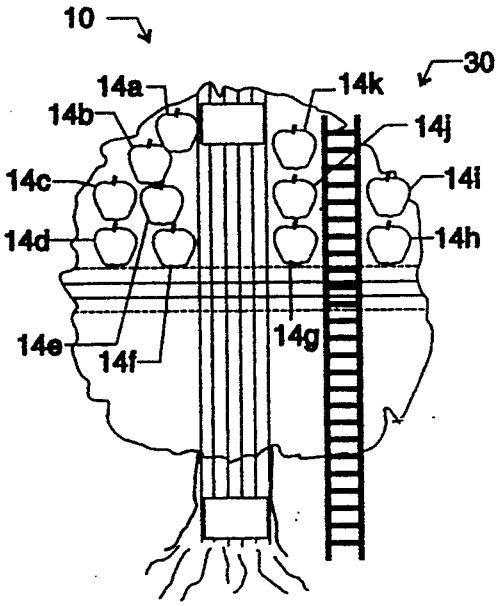
FIG. 4 is an example of a manic disorder analysis provided by the use of the psychological analysis and communication apparatus of the present invention.

An example of a clinically typical subject suffering from mania is illustrated in FIG. 4 wherein an apple tree is utilized as the main structure and apples represent the various indicators. As shown in this figure, the individual placed the following indicators: high energy 14*a*, bad temper 14*b*, lots of laughing 14*c*, poor judgment 14*d*, alcohol or drug use 14*ke*, power issues 14*f*, sleep disturbance 14*g*, shopping sprees 14*h*, gastric problems 14*i*, money issues 14*j*, and can't stand pressure 14*k*. All the indicators were placed in the mania area 30 by the individual, in order to identify the symptoms and feelings he or she was experiencing.

The main structure, illustrated in FIGS. 1–4 can be fabricated from any type of material, such as metal, felt cardboard, flannel, etc. The structure can be fashioned in any size, shape, or design. For example, the main structure may be permanently attached to an easel-like support. The easel-like support can vary in size, from being extremely large, in order to be used in an auditorium, to being smaller and portable, in order to be used on a table or desk. Additionally, the main structure can be permanently attached to any type of material. This material can then be affixed by an attachment means (tape, thumb tacks, VELCRO, etc.) to any display device (black board, bulletin board, etc.).

The psychological apparatus may also be provided with a tray (not illustrated) below the bottom area, in order to store the indicators and banners.

The indicators and banners are attachable and detachable from the main structure. The material used for the indicator and banners should complement the material used to construct the main structure. For example, if the main structure is constructed of metal, the indicators and banners would be fabricated from a magnetic material. A second example is if the main structure is made of flannel, then the indicators and banners would be fabricated from felt.

The various regions (hypomania, normal state, mild depression, depression, and mania) and the tracks are permanently indicated and are accompanied with the appropriate illustrated heading or title.

Figure 5:
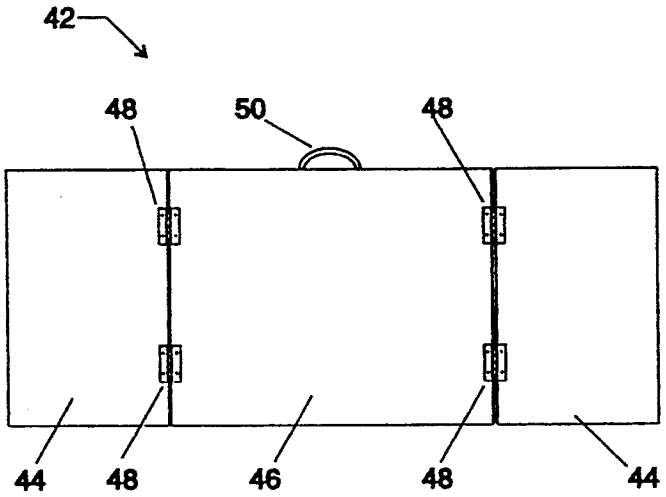
FIG. 5 is a front elevational view of one type of a storage and displayed device for the various indicators and banners in accordance with the present invention.

An example of a display and storage case for the indicators is illustrate in FIG. 5. As seen in this figure, there is shown a display and storage case 42 which has two side doors 44. The doors are attached to a main frame 46 by the use of hinges 48. The hinges provide the doors to open and close freely. Located on the doors is a conventional locking means (not illustrated). This locking means provides the doors to be securely and safely fastened when the case is not being utilized. Located on the top of the main frame is an optional handle 50 which will provide a easy means for carrying the case. The handle can also be located on the side of the case (not illustrated). The doors of the above case can also be used as a neutral or a storage area for unused elements (not illustrated).

The display and storage case is not limited to the shape and design as illustrated in FIG. 5. The display and storage case can be of any shape, style, design or size.

While the invention has been particularly shown and described with reference to an embodiment thereof, it will be understood by those skilled in the art that various changes in form and detail may be made without departing from the spirit and scope of the invention.

I claim:

1. A psychological analysis apparatus comprising:

a first structure;

said first structure forms a main structure;

said first structure includes a top end and a base;

said first structure includes a hypomania region, a normal region, a mild depression region, a mania region, and a depression region;

said first structure includes a top area, a middle area, and a bottom area;

said middle area being substantially smaller than said top area and said bottom area;

said middle area includes said hypomania region, said normal region, and said mild depression region;

said hypomania region is located above said normal region and said mild depression region is located below said normal region;

a first visual marking means divides said hypomania region from said normal region;

a second visual marking means divides said mild depression region from said normal region;

said top area is said mania region;

a third visual marking means divides said hypomania region from said mania region;

said bottom area is said depression region;

a fourth visual marking means divides said mild depression region from said depression region;

a second structure;

said second structure is permanently attached to said first structure;

said second structure extends across a portion of said mania region, hypomania region, said normal region, said mild depression region, and said depression region;

said second structure being substantially thinner than said first structure;

said second structure represents a mixed state region;

a plurality of tracks;

said plurality of tracks are centrally located and vertically aligned on said first structure;

a plurality of indicators;

said indicators being attachable to and detachable from said first structure and said second structure;

said indicators represent a variety of symptoms which are experienced by one suffering from a mood disorder;

a plurality of banners;

said banners being attachable to and detachable from said plurality of tracks; and said banners represent a variety of diagnoses.

2. A psychological analysis apparatus as in claim 1 wherein said top end includes a first symbol and said base includes a second symbol;

said first symbol visually represents an omnipotence state and said second symbol visually represents a no-self state; and said first symbol and said second symbol are permanently attached to said first structure.

3. A psychological analysis apparatus as in claim 2 wherein said base of said first structure includes a suicidal region and located on or at said top end of said first structure is an euphoria region.

4. A psychological analysis apparatus as in claim 1 wherein said first structure is a tree, said indicators are in the shape of apples, oranges, peaches, pears, bananas, apricots, grapefruits, coconuts, walnuts, acorns, pecans, cashews, almonds, or chestnuts and said second structure is a ladder.

5. A psychological analysis apparatus as in claim 1 wherein said first structure is a building, said indicators are in the shape of windows and said second structure is an elevator system.

* * * * *